US006560088B1

(12) United States Patent
Beck et al.

(10) Patent No.: US 6,560,088 B1
(45) Date of Patent: May 6, 2003

(54) METHOD AND CIRCUIT ARRANGEMENT FOR REDUCING NOISE PRODUCED BY ELECTROMAGNETICALLY ACTUATED DEVICES

(75) Inventors: Stefan Beck, Karlshuld; Martin Ebel, Ingolstadt; Josef Poeppel, Fahlenbach, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/472,707

(22) Filed: Dec. 24, 1999

(30) Foreign Application Priority Data

Dec. 24, 1998 (DE) ..... 198 60 272

(51) Int. Cl.[7] ..... H01H 47/32; H01H 47/28
(52) U.S. Cl. ..... 361/154; 361/139; 251/129.01
(58) Field of Search ..... 361/154, 152, 361/143, 144; 251/129.01; 123/490

(56) References Cited

U.S. PATENT DOCUMENTS

| | | | | |
|---|---|---|---|---|
| 4,641,219 A | | 2/1987 | Aiba | |
| 5,053,911 A | * | 10/1991 | Kopec et al. | 123/490 |
| 5,245,501 A | * | 9/1993 | Locher et al. | 324/381 |
| 5,381,297 A | * | 1/1995 | Weber | 361/153 |
| 5,548,210 A | | 8/1996 | Dittrich | |
| 5,645,097 A | | 7/1997 | Zechmann et al. | |
| 5,880,920 A | | 3/1999 | Fischer et al. | |
| 5,959,825 A | * | 9/1999 | Harcombe | 361/152 |
| 6,017,017 A | * | 1/2000 | Lutz et al. | 123/90.11 |
| 6,031,707 A | * | 2/2000 | Meyer | 361/154 |

FOREIGN PATENT DOCUMENTS

| | | |
|---|---|---|
| DE | 3425574 | 1/1985 |
| DE | 4013393 | 10/1991 |
| DE | 4317109 | 11/1994 |
| DE | 19544207 | 6/1997 |
| DE | 19611885 | 10/1997 |
| DE | 19714518 | 10/1998 |
| EP | 0662697 | 7/1995 |
| GB | 1251165 | 10/1971 |

* cited by examiner

*Primary Examiner*—Kim Huynh
(74) *Attorney, Agent, or Firm*—W. F. Fasse; W. G. Fasse

(57) ABSTRACT

In an electromagnetically actuatable device, an electromagnet is driven with a controlled current progression so that the armature of the electromagnet can be actuated at the lowest possible current level while still achieving the most rapid overall increase of the actuating current from zero to maximum amperage. A first portion or range of the current increase is carried out with a steep or jump-like current increasing characteristic. A second portion or range of the current increase is carried out with a more gradual variation of the current. The current levels at the end points of the respective ranges are selected to ensure that the electromagnet is actuated during the second range in which the current varies more gradually. Preferably, two steep or jump-like current increase ranges are respectively provided before and after the second range having the gradual current increase. The armature of the electromagnet is thereby actuated with the lowest possible energy, and the lowest possible acceleration, so that noise and wear are reduced.

20 Claims, 2 Drawing Sheets

METHOD AND CIRCUIT ARRANGEMENT FOR REDUCING NOISE PRODUCED BY ELECTROMAGNETICALLY ACTUATED DEVICES

PRIORITY CLAIM

This application is based on and claims the priority under 35 U.S.C. §119 of German Patent Application 198 60 272.3, filed on Dec. 24, 1998 the entire disclosure of which is incorporated herein by reference.

FIELD OF THE INVENTION

The invention relates to a method and a circuit arrangement for reducing the level of noise produced during actuation of an electromagnetically actuated device, whereby such noise results from excessive acceleration and deceleration of an armature of the device when an excessive actuating current has been applied to the device.

BACKGROUND INFORMATION

Various types of electromagnetically actuated or operated devices, such as electromagnetic valves and relays for example, are known in the art. Such devices typically comprise an electromagnet including a magnetic coil as well as a movable armature, which is moved or changed in position when a sufficient actuating current is applied to the magnetic coil. More particularly, the armature begins to move once the actuating current has reached a predetermined minimum threshold value as the current is increased from a minimum or zero value up to its maximum operating value. Typically, however, the maximum or full actuating current applied to the magnetic coil during the actuation exceeds the minimum threshold level that is necessary for moving and thereby actuating the armature. As a result, the armature is very strongly and excessively accelerated and driven against a mechanical end limit stop or the like.

The rapid excessive acceleration of the armature, and especially the impact of the excessively accelerated armature against its mechanical end limit stop results in the transfer and conversion of excessive amounts of energy. Most importantly, the kinetic energy of the moving armature is converted largely into sound energy and deformation or wear energy when the armature abruptly stops by impacting against the mechanical end limit stop. The greater the actuating current that is applied to the magnetic coil, the greater will be the acceleration and the ultimate velocity and energy of the armature, and thus also the greater will be the amount of noise and wear produced when the armature impacts against the end limit stop. It is therefore desirable to actuate the electromagnet with the lowest possible actuation current that will still effectively move the armature from its initial position to its actuated position.

Throughout this specification, the term "armature" will be used to refer to any component that is driven and moved by the electromagnet or especially the magnetic coil in an electromagnetically actuated device. The process in which the armature is moved, will generally be referred to as the switching process or the actuating process of the electromagnet.

German Patent Publication DE-C2 3,425,574 discloses a method of operating an electromagnetically actuated device in the manner that has generally been described above. Particularly, the disclosed method involves increasing the actuating current provided to the magnetic coil in a gradual or progressive manner, over the entire range between the minimum current (zero amps) and the maximum current that is ultimately applied to the magnetic coil. By gradually or progressively increasing or ramping-up the actuating current, it may be expected that an excessive actuating current could be avoided, because the armature will be actuated as soon as the gradually increasing current reaches the minimum threshold value necessary for driving the armature. The point at which the plunger or armature of the electromagnet begins to move always lies within the range of this gradual or progressive increase of the actuating current, because this range extends continuously from zero amps up to the maximum amperage that is ultimately applied to the magnetic coil.

A disadvantage of such a known approach is that the specific time point of actuation of the armature is not specifically controlled or defined. Thus, if the time period within which the electro-magnetic is to be switched is relatively short, then it becomes absolutely necessary to increase or ramp-up the actuation current from zero amps up to maximum amperage with a relatively steep current increase slope so as to achieve the total ramp-up of the current in the required short time period. Unfortunately, that leads to an actuation of the electromagnet at a higher current level than would be absolutely necessary, i.e. at a higher current than the abovementioned minimum threshold level, because the current keeps rapidly increasing even as the armature is being actuated. As a result, the armature is excessively accelerated, and caused to strongly impact against the mechanical stop, which leads to a higher generation of noise and also increased wear of the various mechanical components.

SUMMARY OF THE INVENTION

In view of the above, it is an object of the invention to provide a method and a circuit arrangement that makes it possible to achieve an exact switching of the electromagnet and/or the armature of an electromagnetically actuatable device, while applying the minimum possible current to the electromagnet for achieving the actuation. More particularly, it is an object of the invention to control the operation of an electromagnetically actuatable device so that the actuation current applied to the electromagnet undergoes the smallest possible rate of increase during the time in which the actuation or switching process is carried out, while achieving the quickest possible total ramp-up of the current from zero amps to maximum amperage. The invention further aims to avoid or overcome the disadvantages of the prior art, and to achieve additional advantages, as are apparent from the present specification.

The above objects have been achieved according to the invention in a method and a circuit arrangement for controlling the actuation current applied to the electromagnet of the electromagnetically actuatable device. According to the invention, the ramp-up of the actuation current is divided into at least two or preferably three portions or ranges. An actuating range or transition function represents only a central portion of the total current variation between zero amps and maximum amps for the process of switching the electromagnet. The ramp-up current variation further includes two non-actuating ranges respectively before and after the actuating range in time. Each of the non-actuating ranges involves a steeper or more rapid increase rate of the current in comparison to the current variation that exists during the actuating range or transition function.

In the first non-actuating range, the current rapidly or steeply increases from a minimum value (e.g. zero amps) up to an initial value at the start of the actuating range. In the second nonactuating range that follows the actuating range, the current rapidly or steeply increases from the final current value of the actuating range up to the maximum value of the current that is ultimately applied to the electromagnet. If only two (rather than three) distinct ranges are used, the non-actuating range may occur before the actuating range (in which case the final current value of the actuating range is equal to the maximum amperage), or after the actuating range (in which case the initial current value of the actuating range is equal to the minimum or zero current value).

The actuating range is particularly selected to cover the time span and/or the current value range in which the switching or actuation of the electromagnet takes place. In this manner, the switching or actuation of the electromagnet is carried out with a gradually increasing current or with some other gentle variation of the current value as will be described in detail herein, while also achieving a rapid or steep increase of the current between the minimum value and the maximum value during the non-actuating ranges before and after the actuating range. Particularly, the current increase during each of the non-actuating ranges may be a substantially instantaneous current jump, limited only by the inherent inductance and available driving voltage of the circuit. Thus, the time duration of each one of the non-actuating ranges may be very brief.

One advantage of the invention is that the electromagnet can be switched or actuated using the lowest possible energy, because it is actuated at the lowest possible current value. Thereby, the invention minimizes the excess energy that is applied to the armature of the electromagnet in the form of excess acceleration, so that the generation of noise and wear on the various components such as relay contacts and the like, can be reduced or especially minimized as a consequence.

A second advantage of the invention is that the total increase of the current from a minimum value (normally zero amps) up to the ultimate maximum value can be carried out quite rapidly, without subjecting the actuation of the electromagnet to such a rapid increase of the current. This is achieved by providing a time period or range of rapid current increase both before and after the actuating range during which the electromagnet is actuated as mentioned above. In this manner, there is substantially a respective current jump from the minimum value very rapidly up to the nominal value at the beginning of the actuating range, followed by another substantial current jump from the current value at the end of the actuating range up to the maximum operating current value. It is understood that the maximum rate of the current jump characteristic is limited by inductivity of the circuit, the driving voltage, and the like. In any event, the current rise rate during the current jumps that take place in the non-actuating ranges are significantly more rapid or steep than the current variation that exists during the actuating range. For example the current increasing rate during the non-actuating ranges may be at least 8 or 10 or 15 times or even significantly more, in comparison to the current increasing rate during the actuating range.

The controlled variation of the current increasing rate or rampup characteristic as described herein can be achieved by using a semiconductor switching element in an appropriate control circuit for controlling the current flow as required. Generally, this is achieved in that the semiconductor switching element applies a controlled variable resistance in the current flow path, which thereby accordingly controls the magnitude of the current flowing through the switching element and the electromagnet. A further advantage of the three-range division of the current increasing or ramp-up characteristic is that the semiconductor switching element only has to operate for a relatively short time in an operating range in which it must provide a controlled electrical resistance. During operation in this range of controlled resistance, the semiconductor switching element generates considerable heat in accordance with the product of current and voltage (I×V). In order to avoid overheating, this heat must be dissipated or rejected, and the operating time must be limited. According to the invention, this operating time in which the semiconductor switching element applies a controlled resistance and therefore generates substantial heat is the actuating range in which the current only gradually or progressively increases or decreases over time. On the other hand, during the initial and final non-actuating ranges, the semiconductor switching element does not apply a significant resistance, so that the current can increase in a substantial jump manner in a very short time interval (limited by the available voltage and the inductivity of the circuit), so that only a small amount of heat is generated in the semiconductor switching element during operation in these ranges.

At the end of the above described current increasing process, the current reaches its ultimate maximum value in that the semiconductor switching element is caused to operate in its lowest resistance state (non-linear saturation state), in which hardly any resistive heating arises. Thus, it is possible to operate the semiconductor switching element and therewith the electromagnet in this maximum current condition for a long period of time, for example possibly several hours, without any problems or concerns, and particularly without subjecting the semiconductor switching element to the danger of overheating or other thermal damage.

A further advantage according to the inventive manner of actuating the electromagnet is that the positive actuation of the armature of the electromagnet is absolutely ensured in each case, as long as sufficient voltage is available for driving the required current magnitude.

In an example embodiment of the invention, the time point at which the electromagnet switches is determined by any one of various technical measurement means, and a control circuit is provided for ensuring that the switching process of the electromagnet takes place within the actuating range, i.e. the range in which the current is only gradually increased, and especially within a middle portion of this actuating range. In this context, the "middle portion" refers to a portion including the center of the actuating range with respect to time or current value, and also means that the actual movement of the armature of the electromagnet only begins somewhat after the beginning of the actuating range and ends somewhat before the end of the actuating range.

The circuit arrangement is particularly embodied to achieve the advantage of correcting or compensating for any variations of the characteristics of the electromagnet or of the operating environmental conditions. For example the circuit arrangement compensates for temperature variations, which could otherwise lead to variations of the actuation of the electromagnet (for example due to the temperature dependence of mechanical friction and the like), whereby the switching process could be shifted to take place outside of the actuating range in which the current is only gently or gradually increased. Particularly, the circuit arrangement compensates for such variations of the operating characteristics by adjusting the current increasing rates and end values of the respective ranges, so that these operating characteristics do not have an effect on the actual time point or time range in which the switching process of the electromagnetic actually takes place. In this context it is further advantageous that the time point at which the switching process is initiated, and/or the time range in which the entire switching process is carried out and completed, can be rather precisely defined and tightly limited to a narrow nominal range of time and/or of current value.

One feature of the invention provides for an initial calibration sequence in order to determine at which point of the current-time curve the electromagnet switches. For this purpose, the initial calibration sequence involves once running through the entire current range from zero amps up to the maximum amperage in the form of a gradual or gently increasing curve, e.g. a linear increase. During the calibration sequence, the actuation or switching of the electromagnet is detected, and thereby the current value and/or time point at which the switching is initiated is determined by various means of measurement or detection as will be described below. Next, a limited range of time and current values around the point at which the switching of the electromagnet takes place is specified as the actuating range in which a gradual or gentle current variation is carried out according to the invention. Before this actuating range, the current will be increased rapidly from zero up to the current value of the actuating range in a jump-like manner, and after this actuating range the current will again be rapidly increased in a jump-like manner up to the maximum current value. The actuating range between the two rapid jump-like current increase ranges comprises a transition function of the current-time curve with a gentler or more gradual current rise inclination in comparison to the current rise that would be required to transition from zero amps up to the maximum amperage using a continuous gradual increasing curve as described above.

This embodiment of the invention relating to the initial calibration sequence for establishing the proper time and current values of the actuating range is especially suitable for carrying out the automatic calibrating and monitoring of devices that include a circuit arrangement according to the invention. Such calibrating can be carried out directly after manufacturing of the respective device, or after a respective specified lengthy period of operation, in order to automatically adjust, readjust, or adapt the circuit operation to the optimal switching time for the electromagnet. The values of current and/or time that are determined during such a run-through of the entire current range from zero amps up to maximum amperage can be stored in a permanent memory provided in the electromagnetically actuatable device. In this manner, the stored values will be available even after a long period of time in which the electromagnet was not in operation.

An apparatus or circuit arrangement according to the invention for carrying out the inventive method includes a control arrangement that has controllable operating parameters in order to influence the current flow characteristic of the current that is provided to the electromagnet of the electromagnetically actuatable device. The circuit arrangement advantageously further includes a memory in which the operating parameters for the control arrangement can be stored.

According to the invention, there are numerous possibilities for determining and establishing the time point or the current value at which the electromagnet switches. According to one embodiment of the invention, this is achieved by monitoring the current or the voltage that exists on the coil of the electromagnet. At the instant at which the armature (i.e. generally the movable part of the electromagnet) starts to move, the inductivity of the magnet arrangement of the electromagnet changes, and this phenomenon is detectable in a sudden voltage and current change, of which the specific time point can be determined by various technical measuring means. Additionally, according to another embodiment of the invention, the amplitude of this current variation or voltage variation can be detected. The magnitude or the energy content of this change of the current and/or voltage is an indication of the magnitude of the excess energy that is applied to the armature, which in turn is an indication of the final velocity of the armature.

In another example embodiment of the invention, the switching process is recognized or detected by a pressure sensor. If the electromagnet is a part of a valve for a fluid, then it is possible to provide and arrange a pressure sensor in such a manner so that it recognizes a variation of the pressure of the fluid that has been caused by the movement of the movable valve component connected to the armature of the electromagnet. In addition to, or instead of the above mentioned pressure sensor, other sensors may also be used. For example, a microphone may be mounted so that it detects the noise produced by the magnet and/or the valve during the switching process, and particularly when the armature or a valve head or valve disk of the valve impacts against a stop member or the like at the end of its travel range. Another alternative is the provision of an acceleration sensor that detects a shock or vibration caused by the impact contact of the movable component against an end limit stop. A further alternative is to provide a microphone that detects the shock wave in the fluid of which the flow is being controlled by the actuated valve. Thus, if a suitable selection and arrangement of the components is provided, the pressure sensor may also carry out the function of the microphone as mentioned above.

Other available possibilities and arrangements for determining the switching time point of the armature comprise a light beam switch that senses the movement of the armature, a fluid flow meter that determines the variation in fluid flow of the fluid being controlled by the valve, an electrical meter that detects the change in the load circuit being controlled by the electromagnet, for example in the case of a relay.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
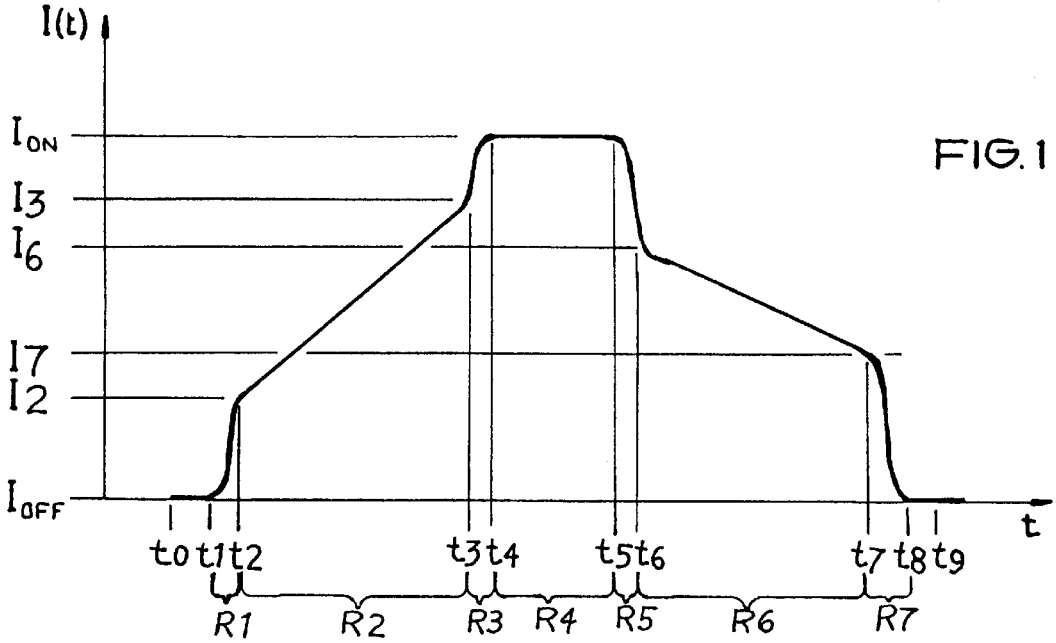
FIG. 1 is a schematic current-time diagram showing the progression of the current provided to an electromagnet for first actuating the armature by increasing the current, and then deactuating the armature by decreasing the current that flows through the magnetic coil.

FIG. 1 schematically shows the time progression of the current that is supplied to and flows through the magnetic coil of an electromagnet of an electromagnetically switch able device such as a relay or a magnetically operable valve. The diagram extends over the operating time of a complete cycle in which the electromagnet is initially at rest, i.e. not actuated, at a time $t_0$, the electromagnet is then switched to an activated state between time $t_1$ and $t_4$, the electromagnet remains in the actuated state from time $t_4$ to $t_5$, and then the electromagnet is switched to a deactivated state between times $t_5$ and $t_8$ and then remains deactivated at time $t_9$.

During this cycle, the current applied to the electromagnet varies between a minimum or "off" current, e.g. zero amps, designated by $I_{OFF}$, and a maximum actuated current designated by $I_{ON}$. The increasing of the applied current from the minimum value $I_{OFF}$ to the maximum value $I_{ON}$ takes place between the time $t_1$ and the time $t_4$, while the actual switching or actuation of the electromagnet, i.e. the movement of the armature of the electromagnet, takes place in a more limited actuating range $R_2$ between time $t_2$ and time $t_3$. In a similar manner on the deactuating side of the current progression curve, the current is switched from the maximum value $I_{ON}$ to the minimum value $I_{OFF}$ between the times $t_5$ and $t_8$, but the actual switching or moving of the armature of the electromagnet takes place in the more limited deactuating range $R_6$ between times $t_6$ and $t_7$. The maximum current $I_{ON}$ is maintained in the operating range $R_4$ from time $t_4$ to time $t_5$.

The special characteristics according to the invention become apparent by comparing the actuating range $R_2$ between times $t_2$ and $t_3$ with the non-actuating or current jump ranges $R_1$ between times $t_1$ and $t_2$, and $R_3$ between times $t_3$ and $t_4$. From time $t_0$ to time $t_1$ the current is at its minimum value, e.g. zero amps. When the electromagnetic device is to be actuated, the current is very rapidly or steeply increased from the minimum value $I_{OFF}$ at time $t_1$ to a value $I_2$. The intermediate current value $I_2$ is selected to ensure that the switching process of the electromagnet will surely not yet take place. In other words, the intermediate current value $I_2$ lies below the minimum threshold current needed to move the armature of the electromagnet. Therefore, it is ensured that the actuation or switching will not yet begin during this non-actuating range $R_1$ in which the current is increased in a rapid or jump-like manner.

Next, the current is more gradually increased from the value $I_2$ to the value $I_3$ between the time points $t_2$ and $t_3$, defining the actuating range $R_2$. In the illustrated example of FIG. 1, the current progresses or ramps-up linearly from the value $I_2$ to $I_3$, but such a linear progression is not a required limitation of the invention. The current values $I_2$ and $I_3$ are selected to ensure that the actuation or switching of the electromagnet will be carried out during the actuating range $R_2$. In other words, the current value $I_3$ is greater than the threshold current level needed to move the armature of the electromagnet. Following the actuation of the electromagnet, the current is once again more rapidly or steeply stepped up from $I_3$ to $I_{ON}$ between times $t_3$ and $t_4$ defining the non-actuating range $R_3$.

The overall current increasing (or decreasing) rate in any one of the respective ranges can be concretely defined as the difference between the starting and ending current values of the respective range, divided by the time duration of the respective range. As an example, the current increasing rate for the range $R_2$ can be defined as $(I_3-I_2)\div(t_3-t_2)$.

It should be understood that it is not absolutely necessary according to the invention to provide the second non-actuating range $R_3$. Namely, if the maximum operating current is close enough to the actuating current needed for the electromagnet, then the gradual increase of the current during the actuating range $R_2$ can continue all the way up to the maximum operating current $I_{ON}$. In other words, in such a case the second intermediate current $I_3$ would be equal to the maximum operating current $I_{ON}$ and the time period between $t_3$ and $t_4$ would simply be omitted from FIG. 1. Such a case is schematically illustrated by a dashed line in FIG. 1.

The current-time curve during the first non-actuating range $R_1$ and during the second non-actuating range $R_3$ is preferably as steep as possible in consideration of the available driving voltage and the inductance characteristics of the circuit. The current increase in these ranges can be substantially jump-like or extremely steep and the time duration of each of these ranges can be very short, especially when compared to the purposely slower ramp-up of the current during the actuating range $R_2$, which can be achieved using the semiconductor switching element in an appropriate control circuit as will be described below in connection with FIG. 2. The maximum operating current $I_{ON}$ in the operating range $R_4$ between times $t_4$ and $t_5$ is achieved by switching the semiconductor switching element to a minimum resistance state so as to provide the maximum possible operating current.

When the electromagnet is to be deactivated or switched to the non-actuated state, the current is first rapidly decreased from the value $I_{ON}$ to the intermediate value $I_6$ in the range $R_5$ from time $t_5$ to time $t_6$. Then from time $t_6$ to time $t_7$ in the deactuating range $R_6$, the current is gradually decreased from $I_6$ to $I_7$, whereby these intermediate current values $I_6$ and $I_7$ are selected to ensure that the deactuation or switching of the armature of the electromagnet will necessarily occur within this range $R_6$. The movement of the armature may be either driven by a return spring as the magnetic coil is deenergized or actively driven by oppositely energizing the magnetic coil to move the armature in the opposite direction. Then from the time $t_7$ to $t_8$ in a range $R_7$, the current is more rapidly decreased from $I_7$ to $I_{OFF}$, at which the current remains till time $t_9$. The rapid current decreases in time ranges $R_5$ and $R_7$ are preferably carried out in a jump-like or step-like manner, similarly to the current increases in time ranges $R_1$ and $R_3$.

The above mentioned respective rapid and gradual current decreases in the ranges $R_5$, $R_6$ and $R_7$ are achieved by the semiconductor switching element operating substantially in an opposite manner as compared to the operation during the current ramp-up in ranges $R_1$, $R_2$ and $R_3$. In the illustrated example embodiment, the intermediate current value $I_6$ on the deactivation side of the current progression is lower than the intermediate current $I_3$, and the current $I_6$ is greater than the current $I_2$. It should be understood that for different electromagnetically actuatable devices, the current $I_6$ could be equal to or even greater than the current $I_3$, and similarly the current $I_7$ could be equal to or less than the current $I_2$. In each case, the respective current values at the end points of the actuating range $R_2$ and the deactuating range $R_6$ must be selected to ensure that the positive actuation and deactuation, respectively, of the electromagnetic device takes place within the defined ranges.

Figure 2:
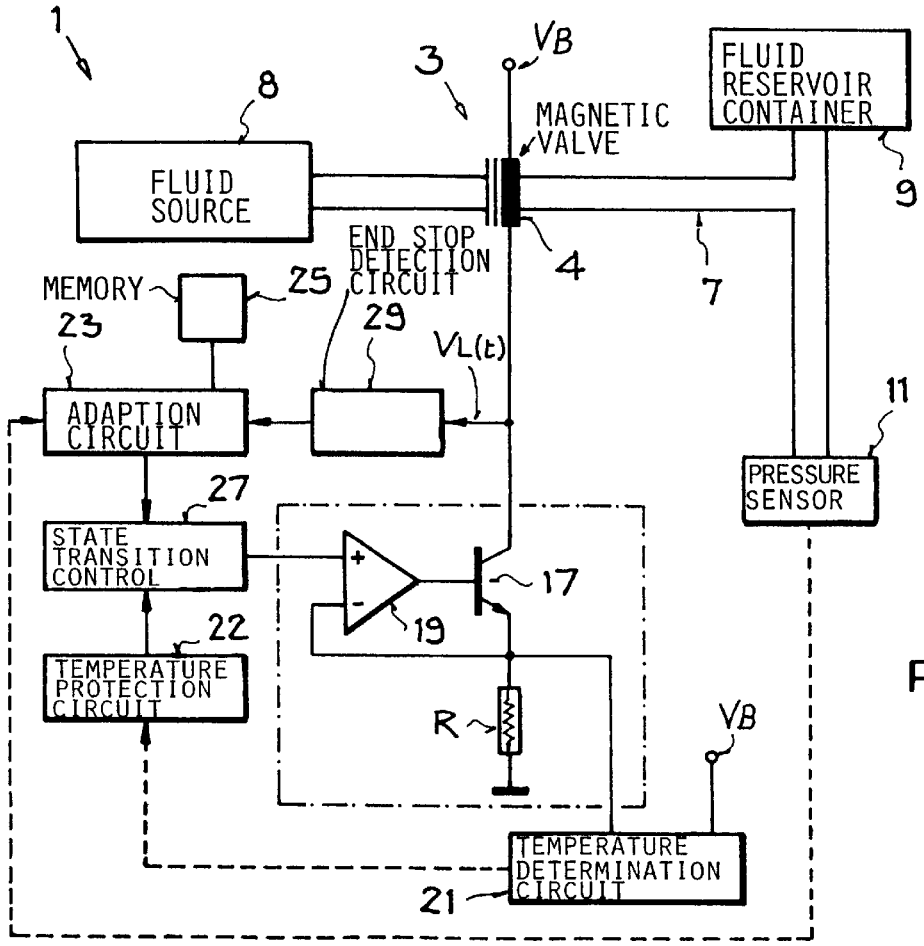
FIG. 2 is a schematic block circuit diagram of a circuit arrangement according to the invention for carrying out the inventive method of operating an electro-magnetically actuated device.

FIG. 2 schematically shows a circuit arrangement 1 for carrying out the method according to the invention. The circuit arrangement 1 comprises a magnetic valve 3 including an electromagnet with a magnetic coil 4 driving an armature that is connected to or embodied as a movable valve member. The magnetic valve 3 and particularly its movable valve member is movably arranged in a pipe or conduit 7 to control the flow of a fluid (such as a gas, for example) that is provided from a fluid source 8 connected to the pipe 7. The fluid source 8 may, for example, comprise an electrically driven air compressor that provides compressed air as the above mentioned fluid into the pipe 7 at different air pressures as selected with an appropriate controller for the compressor.

When the magnetic valve 3 is switched to an open or flow-through condition and the pressure of fluid provided by the fluid source 8 is greater than the pressure prevailing in a fluid reservoir container 9, then the fluid will flow from the fluid source 8 through the magnetic valve 3 and the pipe 7 into the container 9 so as to fill this reservoir container 9. On the other hand, if the pressure selected in the fluid source 8 is lower than the pressure prevailing in the fluid reservoir container 9, when the valve 3 is open, fluid will flow from the reservoir container 9 through the pipe 7 and the valve 3 back out through the fluid source 8 so as to empty or reduce the pressure in the fluid container 9. A pressure sensor 11 is also connected to the pipe 7 in order to monitor the fluid pressure existing at any time in the pipe 7. Thereby, the pressure sensor 11, or the respective pressure signal provided thereby, on the one hand can be used to operate and monitor the operation of the overall device, and on the other hand can be used to recognize the specific time point at which the magnetic valve 3 switches between the opened and closed conditions or between the closed and opened conditions.

The circuit arrangement 1 further comprises a current controlling arrangement that controls the current provided to the magnetic coil 4 of the magnetic valve 3. The key components of the current controlling arrangement include a semiconductor switching element such as a transistor 17 in the present example, and an operational amplifier or op-amp 19, so that the current control arrangement essentially provides a controllable current source. The control electrode or base of the transistor 17 is connected to the output of the op-amp 19. The collector of the transistor 17 is connected in series through the magnetic coil 4 to a positive voltage supply VB. On the other hand, the emitter of the transistor 17 is connected in series through a resistor R having a known resistance value to ground. Thus, the output of the op-amp 19 controls the operation of the transistor 17, which thus selectively is switched among a low resistance conducting state, a high resistance non-conducting or OFF state, and a range of continuously variable resistance to achieve a variable current flow from the positive voltage supply VB, through the magnetic coil 4 of the magnetic valve 3, and through the switching element or transistor 17 and the known-value resistor R to ground.

A temperature determination circuit 21 is respectively connected to or otherwise detects the supply voltage VB and the voltage between the emitter of the transistor 17 and the resistor R having a known resistance value. Thereby, the temperature determination circuit 21 determines the current flowing through the transistor 17, especially in the low-resistance saturated state, taking into account the voltage drop across the known resistor R. In connection with the known resistance of the resistor R, and the known resistance of the transistor 17 in the low-resistance saturated condition (for example from the known voltage drop across the collector and the emitter of the transistor 17 in the saturated state), the resistance of the magnetic coil 4 is determined by the circuit 21. The temperature determination circuit 21 compares the instantaneously determined resistance of the magnetic coil 4 to a previously measured resistance-temperature function or a plurality of data values representing resistance-temperature pairs which have been stored in a memory, based on prior measurements of the characteristic temperature dependent resistance of the coil 4.

Thereby, the temperature determination circuit 21 uses the determined instantaneous resistance value to determine the instantaneous temperature of the magnetic coil 4. As long as the temperature of the magnetic coil 4 remains within an acceptable operating range, the operation thereof is continued normally without interruption. If the coil temperature exceeds a prescribed maximum limit temperature, however, then the temperature determination circuit 21 carries out protective measures or counter measures to prevent overheating or thermal damage of the electromagnet. For example, in such a case a temperature protection circuit 22 changes the operation of the op-amp 19 as driven through the positive input thereof, which in turn changes the current flowing through the magnetic coil 4 of the electromagnet 3. If a micro controller having an analog input is available in the device, it is very simple to determine the electromagnetic coil temperature in the above described manner without any significant additional cost or complexity.

When the magnetic valve 3 begins to change its state from open to closed or from closed to open, more specifically when the armature of the electromagnet of the magnetic valve 3 begins to move, a characteristic pressure variation will be caused in the fluid in the pipe 7. The pressure sensor 11 monitoring the pressure of the fluid in the pipe 7 will detect such a characteristic pressure variation and provide a corresponding signal to an adaption circuit 23 comprising a control arrangement that cooperates with an electronic memory 25. The adaption circuit 23 provides a signal to a state transition control 27 by means of which the current flowing through the magnetic coil 4 is controlled or regulated. Namely, the output of the state transition control 27 is connected to the positive input of the op-amp 19, by which the switching state of the transistor 17 is controlled.

The possibility is also illustrated, that the voltage VL(t) is detected at the output side of the magnetic coil 4, i.e. between the magnetic coil 4 and the collector of the transistor 17, and provided to an end stop detection circuit 29 which determines when the armature or movable valve element of the magnetic valve 3 has reached the end limit stop, based on the characteristic change in the output voltage associated therewith. The end stop detection circuit 29 provides a corresponding signal to the adaption circuit 23. In this context, the end stop detection circuit 29 not only determines the time point of the voltage change signalling when the armature has reached its end limit stop, but also the amplitude of such a voltage change from which the terminal velocity of the armature is determined.

The state transition control 27 carries out the ultimate control of the current supplied to the electromagnet, by means of the op amp 19 and the transistor 17 as described above. Namely, the state transition control 27 receives respective input signals from the temperature protection circuit 22, and through the adaption circuit 23 from the pressure sensor 11 and from the end stop detection circuit 29, and further in connection with values or operating parameters stored in the electronic memory 25. The electronic memory 25 may, for example, store data relating to correlated sets of data including pressure conditions that may be measured by the pressure sensor 11, voltage conditions that may be determined through the end stop detection circuit 29, and desired operating states or operating conditions of the respective electromagnetically operated device. The state transition control 27 comprises a processor that generates a pulse width modulated signal (PWM signal) based on the above mentioned respective inputs and corresponding to the instantaneous desired time progression of the current-time curve. The pulse width modulated signal is in turn integrated to provide an analog signal, which is provided to the positive input of the op-amp 19. The voltage prevailing at the emitter output, i.e. upstream of the known resistor R, is provided as a feedback to the negative input of the op-amp 19.

In an arrangement or embodiment including a plurality of the circuit arrangements shown in FIG. 2, a single processor as just described can be allocated in common to several of such circuit arrangements. Overall, the processor carries out the control in such a manner: that the switching time point lies as close as possible to the middle of the gently increasing range $R_2$ or the gently decreasing range $R_6$ of the current-time curve; that these two ranges $R_2$ and $R_6$ are as short as possible in time while still taking into account the required switching accuracy and the possibility of interference and the like in the operation of the electromagnet; and that in the event of any interference arising during the operation of the electromagnet, a self-regulating control is carried out so as to re-establish the above mentioned conditions as quickly as possible and particularly so as to prevent an interfering deviation from the proper operation of the device.

As another possibility or alternative, it is recommendable in some applications to provide for the recognition of the beginning of movement of the armature of the electromagnet by monitoring the output voltage or current. For example, the end stop detection circuit 29 can also be used for detecting the commencement of movement of the armature. Such a feature can be provided instead of or in addition to the monitoring of the switching process by means of the pressure sensor 11.

Figure 3:
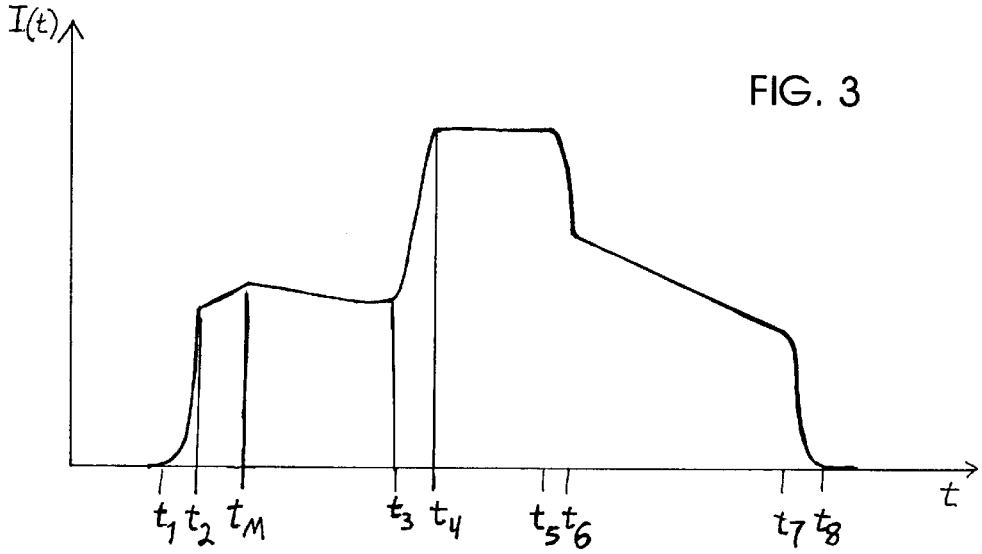
FIG. 3 is a schematic current-time diagram showing a current progression generally similar to that of FIG. 1, but using a temporary current reduction after the movement of the armature has been initiated.

The gradual rise and the gradual decrease of the current in the above described ranges $R_2$ and $R_6$ does not have to be carried out in the form of a substantially linear ramp characteristic. Instead, substantially any desired or useful current curve shape or transition function can be used. Moreover, the curve function does not necessarily have to increase or decrease in a monotonous fashion. Rather, the curve may include bends, deflections, or sharp kinks. According to one advantageous feature of the invention, the transition function can be controlled so that the current is initially increased to slightly above the minimum threshold value necessary for initiating the movement of the armature of the electromagnet, and thereafter the current is temporarily gradually reduced, so that the armature is accelerated as little as possible while still completing the movement of the armature. This can be useful especially in cases in which the initial movement or starting of the armature requires a higher current than is required for maintaining the movement of the armature. Such a current progression is shown in FIG. 3. The instant at which the armature of the electromagnet begins to move is detected by the pressure sensor 11 and/or the end stop detection circuit 29 as described above. In FIG. 3, the time point at which the armature begins to move is designated $T_M$.

Figure 4:
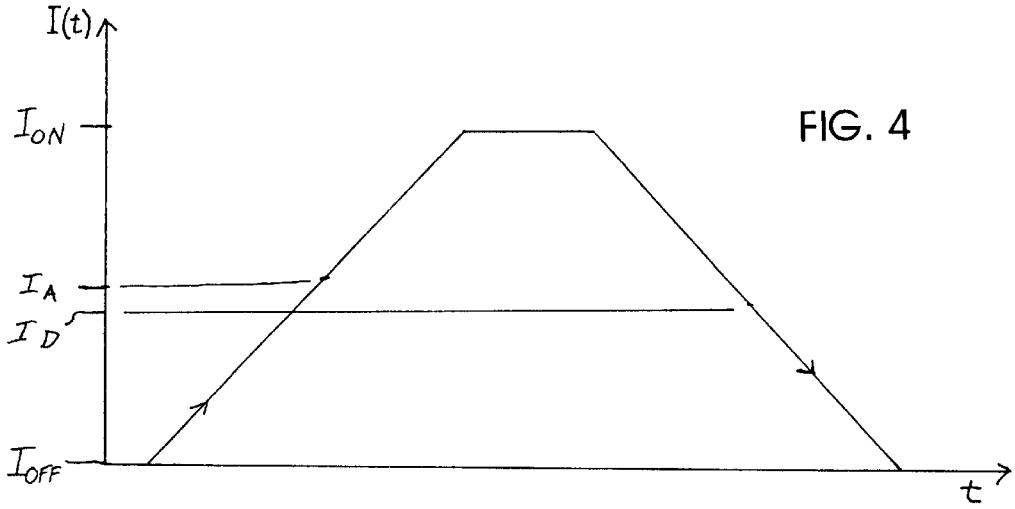
FIG. 4 is a schematic current-time diagram of the current progression during an initial calibration sequence for determining the switching point of the electromagnet.

As has been described above, the point of the current-time curve at which the electromagnet switches, can be determined in an initial calibration sequence involving a single run-through of the entire current in the form of a continuous gradually increasing current curve. Such a calibration sequence is shown from time in FIG. 4. Once data has been collected from such a calibration sequence to establish the conditions associated with the starting and completion of the switch-over process, these data can be stored in a memory as described above, and are used later for controlling the operation of the controllable current supply as has also been described above.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. Each circuit block of the present circuit arrangement can be embodied with any known circuit elements for achieving the described functions.

What is claimed is:

1. A method of operating an electromagnetically actuated device including an electromagnet, comprising the following steps:

a) supplying an electrical actuating current to said electromagnet;

b) increasing said actuating current from a minimum value to a first value during a first time range, at a first current increasing rate which is defined as the difference between said first value and said minimum value further divided by the duration of said first time range; and c) varying said actuating current from said first value to a second value greater than said first value during a second time range, at a second current increasing rate which is defined as the difference between said second value and said first value further divided by the duration of said second time range;

wherein said first value and said second value are selected so that said electromagnet is not actuated by said actuating current during said first time range and is positively actuated by said actuating current during said second time range; and wherein said first current increasing rate is greater than said second current increasing rate.

2. The method according to claim 1, wherein said first current increasing rate is at least eight times said second current increasing rate.

3. The method according to claim 1, wherein said second value is a maximum operating current value, and further comprising a step of continuously applying said actuating current to said electromagnet while maintaining said maximum operating current value as a constant during an operating time range immediately following said second time range.

4. The method according to claim 1, wherein said second value is less than a maximum operating current value, and further comprising after said step c) another step d) that comprises increasing said actuating current from said second value to said maximum operating current value during a third time range, at a third current increasing rate which is defined as the difference between a said maximum operating current value and said second value further divided by the duration of said third time range, wherein said third current increasing rate is greater than said second current increasing rate.

5. The method according to claim 4, wherein said varying of said actuating current in said step c) comprises monotonously increasing said actuating current from said first value to said second value.

6. The method according to claim 5, wherein said varying of said actuating current in said step c) comprises linearly increasing said actuating current from said first value to said second value.

7. The method according to claim 4, wherein said varying of said actuating current in said step c) comprises first increasing said actuating current from said first value to an initiating value greater than a minimum threshold current required for initiating actuation of said electromagnet, and then temporarily decreasing said actuating current from said initiating value.

8. The method according to claim 4, further comprising the following steps:

e) determining a time point at which an actuation of said electromagnet actually begins during said second time range;

f) determining whether said actuation of said electromagnet actually takes place during a middle portion of said second time range; and g) depending on and responsive to an outcome of said determining in said step f), if it is determined that said actuation does not actually take place during said middle portion of said second time range, then changing at least one of said first value, said second value, a starting time of said second time range and an ending time of said second time range so that a subsequent actuation of said electromagnet by repeating said steps a) to d) will take place during said middle portion of said second time range.

9. The method according to claim 8, wherein said determining of said time point in said step e) comprises measuring at least one of a voltage and a current value of said actuating current flowing through said electromagnet and detecting a variation therein that is characteristic of an actuation of said electromagnet.

10. The method according to claim 8, wherein said determining of said time point in said step e) comprises measuring a property of a secondary circuit selected from electrical circuits, fluid circuits and optical circuits, that is controlled by said electromagnet in said device.

11. The method according to claim 8, wherein said determining of said time point in said step e) comprises sensing when an armature of said electromagnet physically moves.

12. The method according to claim 8, wherein said determining of said time point in said step e) comprises detecting at least one of an electrical signal variation, a noise, an impact shock, and an optical signal variation caused by an actuation of said electromagnet.

13. The method according to claim 4, wherein said varying and said increasing of said actuating current in said steps b), c) and d) are carried out by flowing said current through a semiconductor switching element in series with said electromagnet, and varying a resistance of said semiconductor switching element to correspondingly achieve said varying and said increasing, and wherein said semiconductor switching element is placed into a minimum resistance saturated state for providing said actuating current with said maximum operating current value.

14. The method according to claim 4, further comprising deactuating said electromagnet by reducing said actuating current from said maximum operating current value to said minimum value in at least two successive stages respectively in at least two successive deactuating time ranges, wherein said current is decreased respectively at different current decreasing rates respectively during said deactuating time ranges, and wherein said actuating current is decreased through a value at which said electromagnet is deactuated in a respective one of said deactuating ranges having a lowest one of said current decreasing rates.

15. The method according to claim 4, further comprising a preliminary calibration step comprising linearly increasing said actuating current from said minimum value to said maximum operating current value, detecting an actuation value of said current at which said electromagnet is positively actuated, and setting said first value and said second value so that said actuation value falls therebetween.

16. The method according to claim 1, wherein said device is a magnetic valve.

17. A method of operating an electromagnetically actuated device induding an electromagnet, comprising supplying an electrical actuating current to said device and increasing said current from a minimum value to a maximum value in at least two respective successive stages, wherein said current is increased at a relatively lower rate in one of said stages and at a relatively higher rate in another of said stages, and wherein an armature of said electromagnet is moved from a first end position to a second end position during said one of said stages in which said current is increased at said relatively lower rate.

18. The method according to claim 17, wherein said at least two respective successive stages include respective successive first, second and third stages, wherein said one of said stages in which said armature is moved is said second stage which is between said first and third stages, and wherein said relatively lower rate at which said current is increased in said second stage is a relatively lowest rate of said increasing of said current among said first, second and third stages.

19. A method of operating an electromagnetically actuated device including an electromagnet, comprising the following steps:

a) actuating said electromagnet by supplying an electrical actuating current thereto while varying said actuating current from a minimum value to a maximum value; and b) deactuating said electromagnet by reducing said actuating current from said maximum value to said minimum value in at least two successive stages respectively in at least two successive deactuating time ranges, wherein said actuating current is decreased respectively at different current decreasing rates respectively during said successive deactuating time ranges, so that said electromagnet is deactuated and an armature of said electromagnet moves from an actuated position to a deactuated position during a respective one of said stages having a lowest one of said current decreasing rates.

20. The method according to claim 19, wherein said at least two successive stages respectively in at least two successive deactuating time ranges include respective successive first, second and third stages respectively in first, second and third deactuating time ranges, and wherein said one of said stages during which said electromagnet is deactuated is said second stage which is a between said first and third stages.

* * * * *